US006168702B1

(12) United States Patent
Varadaraj et al.

(10) Patent No.: US 6,168,702 B1
(45) **Date of Patent: *Jan. 2, 2001**

(54) CHEMICAL DEMULSIFIER FOR DESALTING HEAVY CRUDE

(75) Inventors: Ramesh Varadaraj, Flemington; David W. Savage, Lebanon; Cornelius H. Brons, Washington, all of NJ (US)

(73) Assignee: Exxon Research and Engineering Company, Florham Park, NJ (US)

( * ) Notice: Under 35 U.S.C. 154(b), the term of this patent shall be extended for 0 days.

(21) Appl. No.: 09/258,618

(22) Filed: Feb. 26, 1999

(51) Int. Cl.[7] ..... B01D 17/06; B01D 17/05

(52) U.S. Cl. ..... 204/567; 204/569; 516/148; 516/151; 210/708; 210/748

(58) Field of Search ..... 516/148, 151, 516/FOR 141, FOR 163; 210/708, 748; 204/567, 569

(56) References Cited

U.S. PATENT DOCUMENTS

| | | | | |
|---|---|---|---|---|
| 3,893,918 | | 7/1975 | Favret, Jr. | 210/104 |
| 4,416,796 | * | 11/1983 | Bohn et al. | 516/151 |
| 4,551,239 | * | 11/1985 | Merchant et al. | 210/708 |
| 4,720,341 | | 1/1988 | Arnold | 210/262 |
| 5,449,463 | * | 9/1995 | Elliott et al. | 208/708 |
| 5,672,739 | | 9/1997 | Varadaraj et al. | 562/106 |
| 5,989,436 | * | 11/1999 | Suzumura et al. | 210/708 |

FOREIGN PATENT DOCUMENTS

| | | | |
|---|---|---|---|
| 0696631 | 2/1996 | (EP) | C10G 33/04 |
| WO9605272 | 2/1996 | (WO) | C10G 33/04 |

* cited by examiner

*Primary Examiner*—Richard D. Lovering
*Assistant Examiner*—Daniel S. Metzmaier
(74) *Attorney, Agent, or Firm*—Gerard J. Hughes; Linda M. Scuorzo

(57) ABSTRACT

The chemical demulsifier formulation has the formula:

wherein $R_1$ is H or an alkoxide of from 5 to about 20 carbon atoms; x is an integer of from about 8 to about 22 when $R_1$ is hydrogen and from about 2 to about 5 when $R_1$ is alkoxide; $R_2$ is independently selected from H, $(CH_2CH_2O)_mH$; $R_3$ is independently selected from H, $(CH_2CH_2O)_nH$, and $(CH_2CH(CH_3)O)_nH$; m and n are integers from 1 to 50; and y and z are integers ranging from 2 to 10.

11 Claims, 1 Drawing Sheet

DYNAMIC INTERFACIAL TENSION PLOT FOR (1:4/SJF:ANS CRUDE) WITH & WITHOUT TRIPLE TAIL DEMULSIFIER

CHEMICAL DEMULSIFIER FOR DESALTING HEAVY CRUDE

FIELD OF THE INVENTION

The invention is related to non-phenolic chemical demulsifier formulations useful for crude oil desalting

BACKGROUND OF THE INVENTION

Crude oil contains varying amounts of inorganic salts. The presence of such salts presents difficulties during crude oil processing such as corrosion of the oil processing equipment. In order to mitigate the effects of corrosion resulting from the presence of salts, it is advantageous to reduce the salt concentration to the range of 3 to 5 ppm by weight of the crude oil. This concentration corresponds to approximately 2 pounds of inorganic salts per 1,000 barrels of crude oil.

Among the crude oil desalting methods in use today, electrostatic desalting is frequently used with crudes containing 0.5 to 2% water. Wash water is added until the crude's water content is in the range of 4 to 8 vol. %, and a chemical emulsion breaker is added so that the oil and the aqueous phases can be separated for storage or further processing. As used herein, a crude oil emulsion is a mixture of crude oil and a dispersed aqueous phase, which may be in the form of droplets stabilized by naturally occurring surface active compounds in the crude oil. Additionally, inorganic fines such as clay particles can contribute to emulsion stabilization. Dispersing added wash water into the crude increases both the average droplet number density and the droplet surface area available for binding the surface active components. Increasing droplet surface area results in a reduction in droplet coverage by the surface active components; this results in a decrease in emulsion stability and an increase in droplet coalescence.

In electrostatic separation, brine droplets in the mixture of crude oil, wash water, and chemical emulsion breaker coalesce in between electrodes located in the oil phase. The coalesced aqueous droplets then settle below the oleaginous crude oil phase. The separation may occur in a separator where an effluent brine may be removed. Treated crude containing 3–5 ppm inorganic salts is removed from the upper part of the separator. Intermediate between the oil phase and the brine phase is an undesirable "rag" layer comprising a complex mixture of oil-in-water emulsion, water-in-oil emulsion, and solids. The rag layer remains in the desalter vessel or it may be removed therefrom for storage or further processing.

Electrostatic desalting may undesirably require adding a substantial amount of wash water to the crude prior to desalting. Frequently, water must be purchased for this purpose. Another difficulty in electrostatic desalting results from the quantity and quality of effluent brine, which itself may require further processing before discharge.

Other problems associated with electrostatic desalting include crude incompatibility and the formation of undesirable emulsions. For example, electrostatic desalting becomes more difficult as a crude's concentration of asphaltenes, resins, waxes, and napthenic acids (typically found in "heavy" or "waxy" crudes) increases. Rag layers at the water-oil phase boundary also result in processing difficulties that become more serious as the emulsion becomes more stable, the rag layer increases in volume, or both.

Consequently, there is a need for a crude oil desalting method that limits the formation of undesirable emulsions, is effective with heavy and waxy crudes, that minimizes the quantity of water added prior to crude treatment, and that minimizes the quantity of effluent brine.

Some conventional desalting methods use a demulsifier having a phenolic moiety. In some cases, the presence of such a moiety would be undesirable, and there is therefore a need for a crude oil desalting process that does not make use of a phenol-containing demulsifier.

SUMMARY OF THE INVENTION

In one embodiment, the invention is a crude oil desalting process, comprising:

adding to the crude oil a chemical demulsifier formulation, the chemical demulsifier formulation being present in an amount ranging from about 1 ppm to about 10,000 pm based on the weight of the crude oil and containing:

(a) about 10 wt. % to about 80 wt. % based on the weight of the chemical demulsifier formulation of a surfactant having the formula:

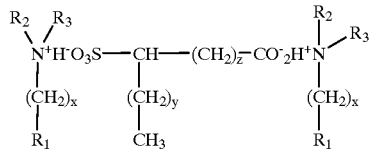

wherein $R_1$ is H or an alkoxide of from 5 to about 20 carbon atoms;

x is an integer of from about 8 to about 22 when $R_1$ is hydrogen and from about 2 to about 5 when $R_1$ is alkoxide;

$R_2$ is selected independently from H, $(CH_2CH_2O)_mH$, and $(CH_2CH(CH_3)O)_mH$;

$R_3$ is selected independently from H, $(CH_2CH_2O)_nH$, and $(CH_2CH(CH_3)O_nH$;

m and n are integers from 1 to 50;

and y and z are integers from 2 to 10; and (b) about 90 wt. % to about 20 wt. % based on the weight of the chemical demulsifier formulation of a delivery solvent selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof.

In another embodiment, the invention is a composition comprising a crude oil containing a brine of salt and water together with a chemical demulsifier formulation, the chemical demulsifier formulation being present in an amount ranging from about 1 ppm to about 10,000 ppm based on the weight of the crude oil and containing:

(a) about 10 wt. % to about 80 wt. % based on the weight of the chemical demulsifier formulation of a surfactant having the formula:

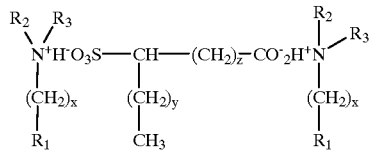

wherein $R_1$ is H or an alkoxide of from 5 to about 20 carbon atoms;

x is an integer of from about 8 to about 22 when $R_1$ is hydrogen and from abou t 2 to about 5 when $R_1$ is alkoxide;

$R_2$ is independently selected from H, $(CH_2CH_2O)_mH$, $(CH_2CH(CH_3)O)_mH$;

$R_3$ is independently selected from H, $(CH_2CH_2O)_nH$, $(CH_2CH(CH_3)O)_nH$;

m and n are integers ranging from 1 to 50;

and y and z are integer s ranging from 2 to 10; and (b) about 90 wt. % to about 20 wt. % based on the weight of the chemical demulsifier formulation of a delivery solvent selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof.

BRIEF DESCRIPTION OF THE DRAWING

The FIGURE shows a dynamic interfacial tension plot for a crude oil sample with and without the chemical demulsifier formulation.

DETAILED DESCRIPTION OF THE INVENTION

Figure 1:
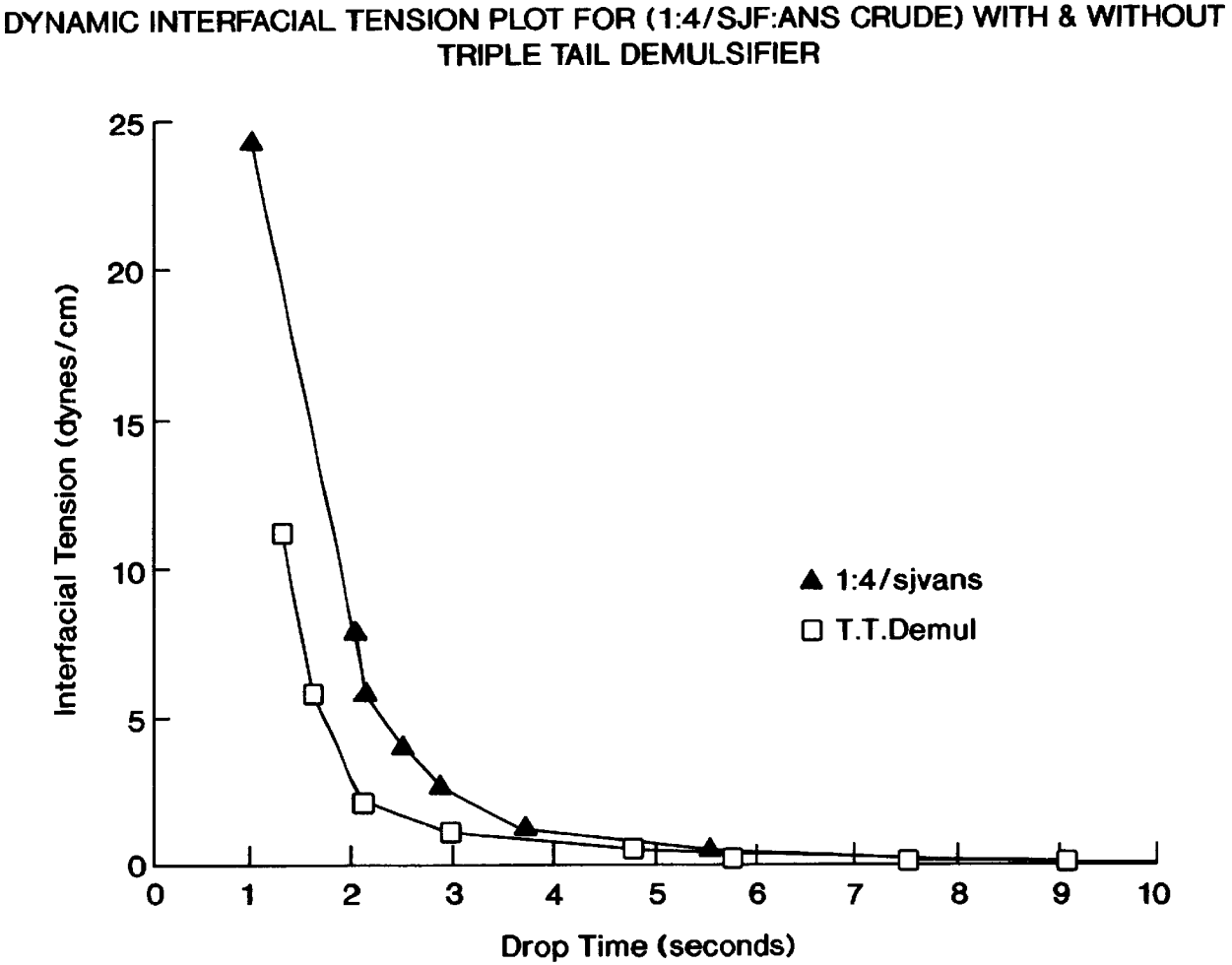

The invention is based on the discovery that brine droplet coalescence in crude oil can be enhanced by adding chemical emulsion breakers to the crude oil emulsion and then subjecting the mixture to electrostatic desalting. Typically, brine droplets in crude oil are stabilized by a mixture of surface active components such as waxes, asphaltenes, resins, and naphthenic acids that are electrostatically bound to the droplet's surface. Such components provide an interfacial film over the brine droplet resulting in highly elastic collisions between droplets during processing, resulting in diminished droplet coalescence.

While the invention can be practiced with any crude oil containing a brine, it is preferably practiced with heavy or waxy crude oils. Heavy or waxy crude oils have one or more of the following characteristics:

(a) The crude oil has an API gravity ranging from about 5 to about 30.

(b) The crude oil has a high naphthenic acid concentration, characterized by a high "TAN" number (the TAN number represents the number of milliequivalents of potassium hydroxide required to neutralize 1 gram of crude oil).

(c) The fraction of the crude oil insoluble in n-heptane ranges from about 0.5 wt. % to about 15 wt. %.

Adding water to the crude can decrease the concentration of the surface active components on the surface of each droplet because the number of droplets is increased without increasing component concentration. It has been discovered that the amount of added water required for desalting may be minimized by adding a chemical emulsion-breaker to the crude that is capable of displacing the surface active components from the brine droplets.

Chemical emulsion-breakers usefuil in the practice of the invention do not have phenolic moieties. Preferably, the chemical emulsion-breakers are three-tailed surfactants having the formula:

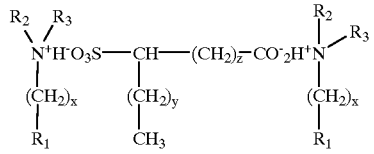

wherein $R_1$ is H or an alkoxide of from 5 to about 20 carbon atoms;

x is an integer of from about 8 to 22 when $R_1$=H and from about 2 to 5 when $R_1$ is an alkoxide;

$R_2$ is selected independently from the group consisting of H, $(CH_2CH_2O)_mH$, and $(CH_2CH(CH)_3)O)_mH$;

$R_3$ is selected independently from the group consisting of H, $(CH_2CH_2O)_nH$, and $(CH_2CH(CH)_3)O)_nH$ m and n are integers from 1 to 50; and y and z are integers from 2 to 10.

Such surfactants are described in U.S. Pat. No. 5,672,739, incorporated by reference herein.

Preferably, the chemical emulsion-breaker is used in combination with a delivery solvent. Delivery solvents useful in the practice of this invention include diethylene glycol monobutyl ether, dipropylene glycol monobutyl ether, aromatic naphtha, isoparaffinic solvent, cycloparaffinic solvent, aromatic solvent, oxygenated solvents, such as diethylene monobutyl ether benzyl alcohol, and mixtures thereof. The preferred formulation comprises about 10 wt. % to about 80 wt. % chemical emulsion breaker and about 20 wt. % to about 90 wt. % diethylene glycol mono butyl ether. Particularly preferred is a formulation of about 50% chemical emulsion-breaker and about 50% diethylene glycol mono butyl ether.

An effective amount of the chemical emulsion-breaker-delivery solvent formulation ("chemical demulsifier formulation") is combined with the crude oil. An effective amount of the formulation is the amount necessary to displace the surface active component from the brine droplets and render the brine droplets more amenable to coalescence. The effective amount ranges from about 5 ppm to about 10,000 ppm based on the weight of the crude oil, with about 5 ppm to about 40 ppm being preferred.

In the preferred embodiment, a crude oil and a chemical demulsifier formulation are combined and then desalted under electrostatic desalting conditions. Electrostatic desalting is known to those skilled in the art of crude oil processing. Accordingly, the crude is desalted in a vessel having electrodes at potentials ranging from about 10,000 volts to about 40,000 volts, A.C. or D.C. Voltage gradients present in the vessel range from about 500 volts per inch to about 5,000 volts per inch, preferably at a potential ranging from about 500 to about 1,000 volts per inch. Crude oil temperature ranges 220° F. to about 300° F., and residence times range from about 1 to about 60 minutes, preferably from about 1 to about 15 minutes.

In the practice of the invention, mixing energy may be applied to the mixture of the crude oil emulsion and chemical demulsifier formulation in order to increase brine droplet coalescence rate. When mixing is used, it is important to carefully control mixing geometry and mixing energy. The mixing may be conventional ("static") or opposed-flow, and may occur in the same vessel as electrostatic desalting.

In opposed-flow mixing, two or more counter-currents of the mixture of crude oil emulsion and chemical demulsifier impact and intermingle. Opposed propeller(or impeller) and opposed jet (or nozzle) configurations are nonlimiting examples of opposed-flow mixing.

In the opposed-propeller geometry, at least two counter-rotating propellers are immersed in the crude oil-brine mixture in order to form opposed streams within the mixture. The streams of the mixture impact and intermingle in the volume between the propellers. The propellers may be in close proximity in the same reservoir or vessel, in different regions of the same vessel, or in connected vessels or reservoirs with baffles or pipes providing conducting means for directing the streams to a region where opposed-flow mixing can occur. Parameters such as propeller spacing, propeller angular speed, and the nature of any conducting means may be determined by those skilled in the art of mixing from mixture properties such as viscosity and the desired mixing energy.

In the opposed jet geometry, the crude oil-brine mixture is separated into at least two streams. Conducting means such as pipes are used to direct the streams into an opposed-flow configuration. Accordingly, the longitudinal axes (the axes in the direction of flow) and the outlets of the pipes are oriented so that the streams impact and intermix in a region between the outlets. Preferably, two opposed pipes are employed and the angle subtended by the longitudinal axes of the pipes is about 180°. The outlets may be in the form of nozzles or jets. As in the opposed propeller geometry, parameters such as the surface area of the conduits, the flow rate of the mixture in the conduits, the size and shape of any nozzle or jet employed, and the distance between the outlets may be determined by those skilled in the art of mixing from mixture properties such as mixture viscosity and the desired mixing energy.

Importantly, when mixing is used, the mixing energy rate is controlled in a range where brine droplet coalescence occurs. Too great a mixing energy would result in brine droplet break-up, and too low a mixing energy would result in too few brine droplet collisions. Mixing energy rates (mixing power) ranges from about 0.1 hp per 1000 gallons of the mixture of crude oil emulsion and chemical demulsifier to about 3 hp per 1000 gallons, with about 0.2 hp per 1000 gallons to about 0.5 hp per 1000 gallons being the preferred range. The invention can be practiced when the mixture's temperature ranges from about 20 to 150° C. and viscosity ranges from about 1 to about 250 cP. Preferably, mixture temperature ranges from about 80° C. to about 130° C. and viscosity ranges from about 1 to about 75 cP. Care should also be taken to prevent undesirable water vaporization during mixing. Water vaporization can be substantially reduced or prevented by increasing mixing pressure.

In some cases, it may be desirable to add a small amount of wash water to the brine-crude oil mixture in order to optimize the coalescence rate and to extract salt that is not present in a brine phase. When used, the amount of added wash water ranges from about 0.5 to about 8.0 vol. % water based on the total volume of the crude oil, preferably from about 0.5 to about 3.0 vol. %.

While not wishing to be bound by any theory, it is believed that efficient brine droplet coalescence occurs when droplet collision frequency is increased and when individual droplets can be made to collide with an energy great enough to overcome the droplets' interfacial or surface tension so that a larger droplet is formed upon collision. Importantly, mixing energy should not exceed the point at which two droplets collide to produce three or more droplets. Furthermore, mixing energy should be sufficient so that the droplets do not merely collide and recoil away from each other without coalescing, as would happen in cases of insufficient mixing energy. The presence of surface or interfacially active species on the droplets' surface may result in raising or lowering the droplets' interfacial energy and interfacial elasticity. The presence of treatment solutions affecting such species may further alter the droplets' interfacial energy and interfacial film elasticity. Accordingly, mixing energy under opposed-flow conditions may vary in the practice of the invention, depending on the presence of treatment solutions or stabilizing species.

Conventional static mixing is not as effective as opposed-flow mixing in the practice of invention because, it is believed, droplet collisions occur too infrequently and at too low an energy to cause coalescence. In conventional mixing, the neighboring droplets are at rest or move at small velocities with respect to each other, the energy of mixing being directed towards macroscopic fluid motion.

It should be noted that opposed-flow mixing results in one brine droplet coalescence even in cases where the crude oil-brine mixture does not contain a demulsifier or any other treatment solution. Accordingly, opposed-flow mixing can be used to remove droplets of any undesirable liquid impurity suspended in a continuous phase of a second liquid. In addition to crude oil-brine mixtures, such mixtures include crude oil products that contain process-water impurities, droplets in crude oil products resulting from the use of liquid hydrophilic catalysts, mixtures derived from the neutralization of acidic crude oil or products derived from crude oil, and mixtures derived from the caustic treatment of crude oil products and polyurea. It is advantageous to use opposed-flow mixing to enhance droplet coalescence in mixtures that do not contain a demulsifier or treatment solution when the presence of such a demulsifier or treatment solution would be incompatible with or would otherwise undesirably affect the mixture.

As set forth above, chemical demulsifier formulations and opposed-flow mixing, whether used alone or in combination, are useful in improving electrostatic desalting processes. In addition, it has been discovered that such mixing and formulations, alone or in combinations, are useful in improving other common forms of brine-crude oil separation, such as gravitational (settling) and centrifugal separation. In gravitational separation, for example, the increase brine droplet size resulting from the use of chemical demulsifier formulations, opposed-flow mixing, or both, shortens the retention time necessary for desalting.

EXAMPLES

In order to illustrate the invention one member of the surfactant class was synthesized. A C18 hydrocarbon chain length amine with a 10 mole ethylene oxide was neutralized with 0.5 molar equivalent of sulfonated oleic acid to result in the triple tail surfactant. For the surfactant used in these examples, $R_1$ is H, $R_2$ and $R_3$ are $(CH_2CH_2O)_{10}H$, x is 18, y is 8, and z is 7. The chemical demulsifier contained 50 wt. % of the surfactant and 50 wt. % of dipropylene glycol n-butyl ether delivery solvent. A heavy crude blend {1:4 San Jaoquin Valley (SJV): Alaskan North Slope} was chosen to demonstrate the invention.

Example 1

Dynamic Interfacial Tensiometry Performance

Dynamic interfacial tensiometry was used to determine the dynamic effectiveness of the demulsifier formulation. It is desirable to lower the crude oil-brine interfacial tension to a value of <5 dynes/cm within about 2 seconds of contacting of the aqueous and oil phases.

The FIGURE shows the interfacial tension versus time profile for the SJV/ANS crude blend without demulsifier and with 20 ppm of the triple tailed surfactant demulsifier formulation measured against brine. We observe that the emulsifier formulation not only lowers the crude-brine interfacial tension to a value of <5 dynes/cm but the equilibrium interfacial tension is reached within 3 seconds of introduction of sea water into crude oil containing the demulsifier. The effectiveness of the demulsifier formulation in rapidly reducing the interfacial tension is indicative of potentially good demulsification performance.

Example 2

Desalting Performance

A crude oil blend comprising 50 gms of San Joaquin Valey (SJV) and 200 gms of Alaskan North Slope (ANS) was prepared in a 500 ml polyethylene bottle. The mixture was tumbled for about 20 mins in a conventional paint mixer type tumbler. This starting blend was analyzed for moisture and chloride content (entry #1, Table 1).

20 ppm of the chemical demulsifier was added to the blend, and the resulting mixture was tumbled for about 20 minutes before being divided into two sub-samples.

Sub-sample 1 was subject to electrostatic desalting at 80° C. for 30 minutes. The treated crude was analyzed for moisture and chloride (entry #2, Table 1).

Sub-sample 2 was subject to opposed-flow mixing, as set forth below, prior to electrostatic desalting. The treated crude was analyzed for moisture and chloride (entry #3, Table 1).

Opposed-Flow Turbulence Procedure 200 grams of sub-sample 2 was added to a 300 ml autoclave equipped with two laboratory marine propeller mixers (1" blade). To create opposing liquid flows, the top propeller's pitch was reversed compared to the pitch of the bottom blade. This arrangement directs the top blade's liquid flow downward and opposite to the upward liquid flow of the bottom blade. The distance between the blades was about 2 inches. The mixture was pressurized to about 700 kPa with nitrogen to minimize water vaporization. The sub-sample was mixed at about 400 rpm, 80° C. at a pressure of about 1000 kPa for 30 minutes. The mixture was cooled to room temperature with ice cold water surrounding the autoclave, while the mixer speed was at 200 RPM and the heater turned off.

As a control, the crude blend without addition of chemical demulsifier formulation was subject to electrostatic demulsification alongside sub-samples 1 and 2. The treated crude was analyzed for moisture and chloride (entry #4, Table 1).

Electrostatic desalting was conducted in a model EDPT-128™ electrostatic dehydration and precipitation tester available from INTER-AV, INC., San Antonio, Tex. Demulsification was conducted at an 830 volt/inch potential for 30 minutes at a temperature of 80° C.

Results in Table 1 demonstrates the effectiveness of the chemical demulsifier formulation. The formulation is effective in dehydrating (80%) and desalting (<5 ppm chloride) the crude blend when subject to electrostatic demulsification.

TABLE 1

| CRUDE OIL TYPE | Salt Concentration (ppm) | % Dehydration |
|---|---|---|
| 1. SJV/ANS crude blend | 30 | — |
| 2. SJV/ANS crude blend + 20 ppm demul. + electrostatic field | <5 | 80 |

TABLE 1-continued

| CRUDE OIL TYPE | Salt Concentration (ppm) | % Dehydration |
|---|---|---|
| 3. SJV/ANS crude blend + 20 ppm demul. + opposed-flow turbulence + electrostatic field | 5 | 79 |
| 4. SJV/ANS crude blend + electrostatic field | 10 | 72 |

What is claimed is:

1. A method for desalting a crude oil containing a brine of salt and water, the method comprising:

adding to the crude oil a chemical demulsifier formulation, the chemical demulsifier formulation being present in an amount ranging from about 1 ppm to about 10,000 ppm based on the weight of the crude oil and comprising:

(a) about 10 wt. % to 80 wt. % based on the weight of the chemical demulsifier formulation of a surfactant having the formula:

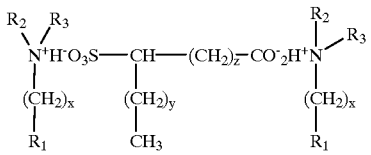

wherein $R_1$ is H or an alkoxide of from 5 to about 20 carbon atoms; x is an integer of from about 8 to about 22 when $R_1$ is hydrogen and from about 2 to about 5 when $R_1$ is alkoxide; $R_2$ is independently selected from the group consisting of H, $(CH_2CH_2O)_mH$, and $(CH_2CH(CH_3)O)_mH$; $R_3$ is independently selected from the group consisting of H, $(CH_2CH_2O)_nH$, and $(CH_2CH(CH_3)O)_nH$; M and n are integers from 1 to 50; and y and z are integers ranging from 2 to 10; and (b) about 90 wt. % to about 20 wt. % based on the weight of the chemical demulsifier formulation of a delivery solvent selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof.

2. The method of claim 1 further comprising separating the brine from the crude oil and formulation under electrostatic desalting conditions at a temperature ranging from about 220° F. to about 300° F., at an electrostatic potential ranging from about 500 to about 5000 volts per inch and for a time ranging from about 15 to about 30 minutes.

3. The method of claim 1 further comprising:

adding wash water to the crude oil until the concentration of wash water in the crude oil ranges from about 1 vol. % to about 8 vol. % based on the volume of the crude oil, and then separating the brine from the crude oil and formulation under electrostatic desalting conditions.

4. The method of claim 2 further comprising mixing the crude oil and formulation under opposed-flow conditions at a temperature ranging from about 20° C. to 150° C., for a time ranging from about 1 minute to about 50 hours, and at a viscosity ranging from about 1 cP to about 250 cP.

5. The method of claim 4 wherein the mixing power under opposed-flow conditions ranges from about 0.1 hp per 1000 gallons to about 3 hp per 1000 gallons.

6. The method of claim 3 further comprising mixing the crude oil and formulation under opposed-flow conditions at a temperature ranging from about 20° C. to 150° C., for a time ranging from about 1 minute to about 50 hours, and at a viscosity ranging from about 1 cP to about 250 cP.

7. The method of claim 6 wherein the mixing power under opposed-flow conditions ranges from about 0.1 hp per 1000 gallons to about 3 hp per 1000 gallons.

8. A composition comprising a crude oil containing a brine of salt and water and a chemical demulsifier formulation present in an amount ranging from about 1 ppm to about 10,000 ppm based on the weight of the crude oil, the chemical demulsifier formulation comprising:

(a) about 10 wt. % to about 80 wt. % based on the weight of the chemical demulsifier formulation of a surfactant having the formula:

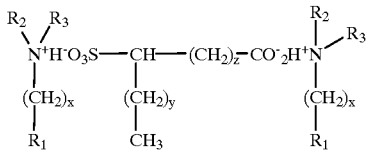

wherein $R_1$ is H or an alkoxide of from 5 to about 20 carbon atoms; x is an integer of from about 8 to about 22 when $R_1$ is hydrogen and from about 2 to about 5 when $R_1$ is alkoxide; $R_2$ is independently selected from the group consisting of H, $(CH_2CH_2O)_mH$, $(CH_2CH(CH_3)O)_mH$; $R_3$ is independently selected from the group consisting of H, $(CH_2CH_2O)_nH$, $(CH_2CH(CH_3)O)_nH$; m and n are integers ranging from 1 to 50; and y and z are integers ranging from 2 to 10; and (b) about 90 wt. % to about 20 wt. % based on the weight of the chemical demulsifier formulation of a delivery solvent selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof.

9. The composition of claim 8 wherein the crude oil is a heavy or waxy crude oil.

10. The composition of claim 9 wherein $R_1$ is H, $R_2$ and $R_3$ are $(CH_2CH_2O)_{10}H$, x is 18, y is 8, and z is 7.

11. The composition of claim 10 wherein the delivery solvent is diethylene monobutyl ether.

* * * * *